United States Patent [19]

Sharp

[11] 4,083,495

[45] Apr. 11, 1978

[54] WATER SPRAY DEVICE

[76] Inventor: Ronald L. Sharp, 2700 S. Federal Blvd., Denver, Colo. 80236

[21] Appl. No.: 673,877

[22] Filed: Apr. 5, 1976

[51] Int. Cl.[2] ..... B05B 9/02

[52] U.S. Cl. ..... 239/287

[58] Field of Search ..... 239/287, 550, 565

[56] References Cited

U.S. PATENT DOCUMENTS

| | | | |
|---|---|---|---|
| 964,178 | 7/1910 | Opitz et al. | 239/287 |
| 974,954 | 11/1910 | Dietcher | 239/565 X |
| 2,889,994 | 6/1959 | French | 239/287 X |
| 3,423,027 | 1/1969 | Small et al. | 239/287 |
| 3,508,709 | 4/1970 | Small et al. | 239/287 |
| 3,770,210 | 11/1973 | Veltkamp | 239/550 |

*Primary Examiner*—John J. Love
*Attorney, Agent, or Firm*—John E. Reilly

[57] ABSTRACT

A spray-type device effects cleaning and sweeping as for walks, driveways, patios, lawns and the like by attachment to a pressurized source such as a garden hose. A T-shaped configuration is employed with an elongated hollow tubular handle for attachment to the source at one end and with a series of members attached in perpendicular relation to the other end of the handle. One of the lower members has a hollow interior in communication with the handle interior and having a series of nozzles attached thereto along one side so as to form a narrow fan-like sheet of spray directed downwardly and forwardly of the nozzle mounting members. The lower members are rigidly interconnected in a solid structural frame with roller wheels or casters attached at opposite ends. The nozzles can include a horizontal slot arrangement which is aligned for producing an overlapping sheet of sprays and the wheel mounts are preferably in an offset relation to the spray line to facilitate control of the angle of impact for the spray on the surface to be cleaned. Supplementary materials can be added to the flow through attachment of an injector-type apparatus at the input handle.

5 Claims, 8 Drawing Figures

WATER SPRAY DEVICE

BACKGROUND OF THE INVENTION

The present invention relates to apparatus pressurized powered sweeping of a surface through use of a pressureized flowable medium. More particularly, the present invention relates to apparatus for sweeping a surface with a broad pattern of pressurized water as received from an attached pressurized source such as a hose. Although primarily useful for cleaning and sweeping relatively solid surfaces such as walks, driveways, patios and the like, the present invention is likewise useful for other applications such as sweeping debris and leaves from a lawn, controlled watering and/or fertilizing of lawns or gardens, and the like.

Various devices have been developed in the past for the purpose of relieving the inefficiency and tedium associated with using a conventional garden hose nozzle and broom for cleaning and sweeping a surface. Thus, it has been suggested that T-shaped apparatus be employed using an extended hollow handle which can be attached to the garden hose or the like at one end of the handle and with a series of spaced spray jets directed from the cross member of the T-shape in proximity to the surface to be cleaned. For instance, one arrangement intended to incorporate both such jets and a rake-type element in a pivotable assembly is shown in U.S. Pat. No. 2,638,730 by Davidson. Various devices of similar T-shaped configuration but not including the pivotal rake assembly are shown in U.S. Pat. Nos. 2,746,072 by Lumpkin, 2,784,030 by Dietzel and 2,692,163 by Geel. The Lumpkin device employs a T-handle with casters mounted at opposite ends with a trailing squeegee blade attached between the wheel mount platform. The Dietzel apparatus includes an arcuate spray member attached between the axles of a pair of wheels with ports therethrough for impinging perpendicularly upon the surface to be cleaned. Geel shows two versions of a T-shaped water sweeper, one of which employs a series of deflector plates and the other of which employs overlapped spray nozzles. In both Geel configurations, a single unitary crossbar is used for the nozzle spray origination with roller wheels directly attached to the ends of that crossbar. Yet another downwardly directing arrangement employing a T-shaped configuration but with a collapsible or pivotable arm around a supporting axle is shown in U.S. Pat. No. 3,508,709 by Small et al.

It has likewise been suggested that the flow associated with a water sweeper-type device can be supplemented as with detergent, fertilizers or the like from a storage container with venturi-type attachment for such supplementation. For instance, U.S. Pat. Nos. 3,064,904 by Roberts and 3,202,362 by Wright illustrate T-shaped sprayers with a supporting platform on the crossbeam of the sprayer. Roberts uses a bypass and separate spray arrangement whereas the Wright dispenser is coupled via an in-line venturi configuration.

Despite the various developments in the prior art there has been a continuing need for a T-shaped sprayer which has adequate strength for the spray crossbeam portion to withstand extensive normal usage. There has likewise been a continuing need for a T-shaped water broom or sprayer-type device which facilitates control by the user of the angle of impingement of the spray upon the surface. Still further, there has been a continuing need for a T-shaped water sprayer which can be easily fabricated from a minimum number of low cost components but in a highly reliable assemblage for long term and rough usage. Such a device should easily accommodate attachment of a supplementary liquid container.

SUMMARY OF THE INVENTION

The present invention is concerned with certain novel and advantageous improvements in surface cleaning and spraying devices which are configured in a T-shape. Such devices are attachable to a pressurized source which is generally a water hose at one end of an elongated tubular handle. The crossbeam completing the T-shaped includes a plurality of spray jets which effect a fan-like spray pattern against the surface to be cleaned and in proximity to that surface. Typically, the crossbeam is supported by rollers at the ends thereof. Although the devices of this nature are typically employed with water as the pressurized source, they can be employed in some circumstances for application to pneumatic sources and the like.

When steel pipe is used for the prior art T-shaped devices for the purpose of rendering the crossbeam sufficiently rigid to withstand typical usage, the resulting weight of such apparatus is prohibitive and not well suited for applications such as lawn sweeping. The development of lightweight tubular extrusions and the like such as polyvinyl chloride or PVC piping significantly reduces the weight associated with such devices and, although durable for some usage, is not generally well suited for a single crossbeam arrangement as is employed in the prior art devices. Furthermore, it is frequently necessary to vary the angle of incidence of the spray pattern against the surface as when particularly obstinate debris is encountered but the wheel mounts for prior art devices render such control of the spray angle difficult or awkward at best.

Accordingly, the present invention employs a hollow, open-ended elongated tubular handle which is adapted at one end for releasable attachment to a pressurized source such as a garden hose. The invention employs at least two elongated members forming the crossbeam assembly in rigid attachment parallel to one another and likewise rigidly attached to the second end of the tubular handle in generally perpendicular relation to at least one of these crossbeam members. One such crossbeam member has a hollow interior in open communication with the tubular handle interior and a plurality of spray nozzles attached in spaced relation for discharging the flowable materials from the pressurized source in a generally parallel but common direction. The crossbeam members are movably supported above the surface to be swept with the nozzle being positioned for impinging the discharge thereof at an angle relative to the surface when the tubular handle is normally hand supported.

The nozzles employed each can include a central passageway opening at one end into the interior of the associated crossbeam member and opening at the other end into a narrow slot oriented parallel to the crossbeam member. This configuration permits production of a relatively narrow but overlapped series of fan-like sprays for impingement upon the surface to be cleaned. As will be shown and described in detail for the preferred embodiment, the crossbeam assembly can be rendered particularly sturdy for normal usage by including one of the crossbeam members in a generally rectangular configuration with the other crossbeam member being attached thereacross for supporting the wheels and further effecting three-dimensional strength of the nozzle assembly. By attaching the wheels to the reinforcing crossbar member, the device is supported on the surface to be cleaned in an offset relation to the location of the array of nozzles over the surface. As a result, pivoting of the nozzle configuration through vertical movement of the handle is advantageously available thereby allowing the user to easily change the angle of incidence of the spray pattern against the surface as needed.

An object of the present invention is to provide a novel improvement for T-shaped water sweeping devices which is structurally sound for long term usage but requires minimal, easily assembled and low cost components.

Another object of the present invention is to provide a novel improvement in T-shaped water sweeping devices which insures rugged supporting configurations of the spray originating elements so as to allow long term normal usage in a reliable manner.

A further object of the present invention is to provide a novel iprovement in T-shaped water sweeping device which facilitates control of the angle of incidence of the spray relative to the surface to be cleaned by the user.

Yet another object of the present invention is to provide a novel improvement in T-shaped water sweeping devices which can provide reliable usage for a wide variety of applications and environments including the cleaning and sweeping of paved surfaces, lawns or the like.

A still further object of the present invention is to provide a novel improvement for T-shaped water sweeping devices which uses minimal low-cost components but is easily adapted for augmenting the sweep flow with supplementary materials.

The foregoing and other objects, features and advantages of the present invention will be more readily apparent in view of the following detailed description of an exemplary preferred embodiment.

DETAILED DESCRIPTION OF THE PREFERRED EMBODIMENT

Figure 1:
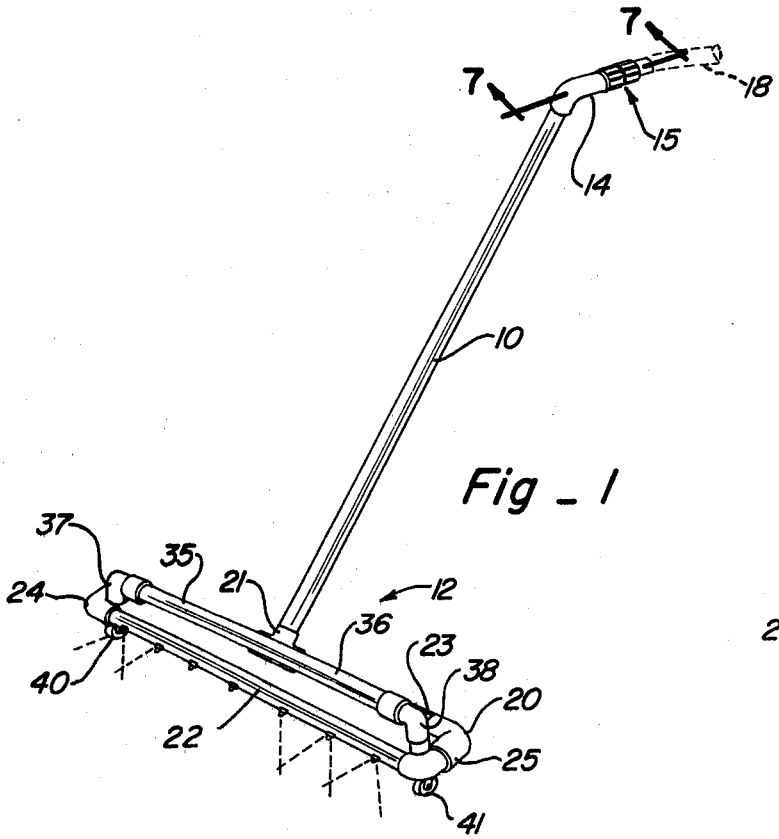
FIG. 1 is a perspective view of the preferred embodiment particularly illustrating its manner of usage for sweeping.

The exemplary preferred implementation of the present invention as an improvement in T-shaped water brooms is illustrated in perspective view in FIG. 1. The T-shape is produced by an elongated tubular handle 10 which is attached in rigid relation at its lower end to a crossbeam assembly 12. At the other end of handle 10 is elbow 14 conveniently located for gripping and which terminates in a hose attaching assembly 15.

The details of the crossbeam assembly 12 are shown in FIGS. 2–5. The single pipe type of crossbeam assemblies employed in the prior art devices either were too heavy if fabricated from steel pipe or too weak for normal usage if fabricated from plastic pipe. These significant disadvantages are overcome by assembly 12 which includes a hollow elongated member 20 formed in a rectangular configuration with the hollow interior thereof being in open communication with the hollow interior of handle 10 at T-junction 21. This rectangular assembly 20 is formed with a front elongated hollow member 22, a spaced but parallel hollow rear member 23 to which T-junction 21 is attached and side connectors 24 and 25 which complete the rectangular configuration. Side portions 24 and 25 as illustrated are constructed of a pair of elbow segments.

Figure 2:
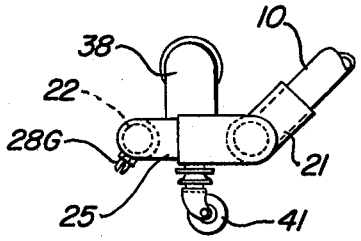
FIG. 2 is a side view of the crossbeam assembly.
Figure 3:
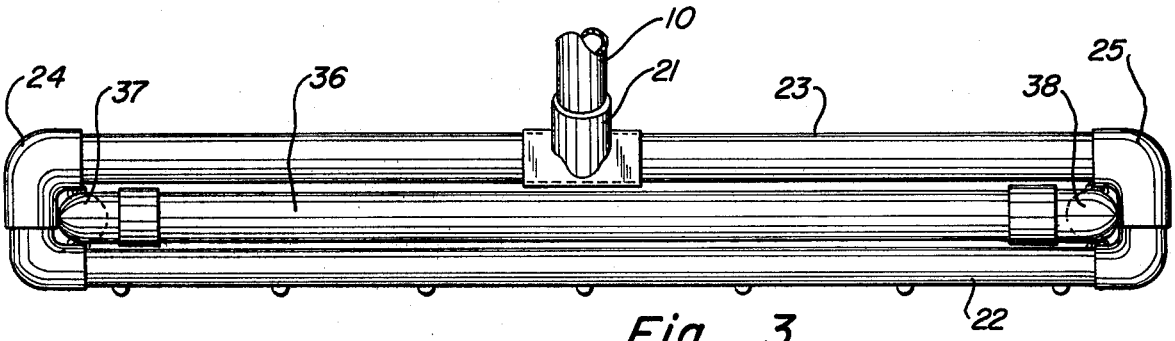
FIG. 3 is a top view of the crossbeam assembly.
Figure 4:
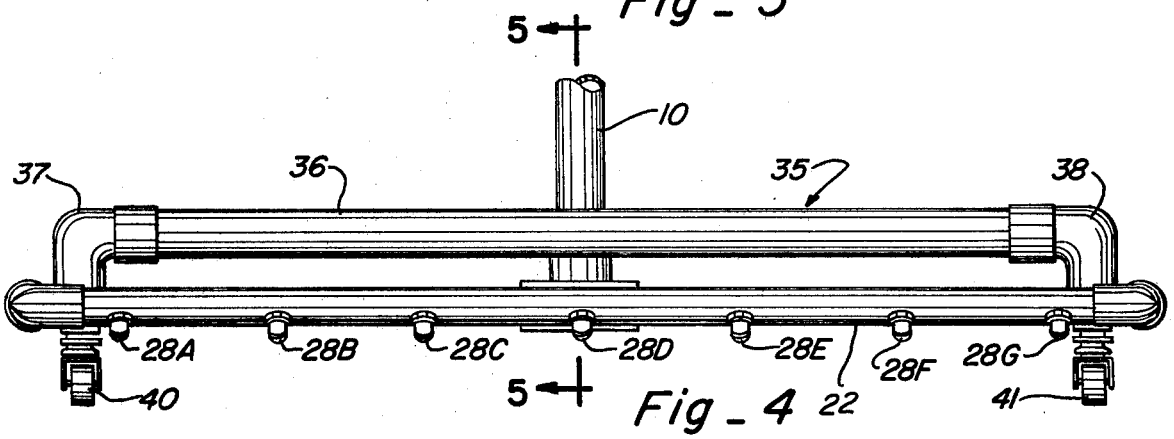
FIG. 4 is a front view of the crossbeam assembly.
Figure 5:
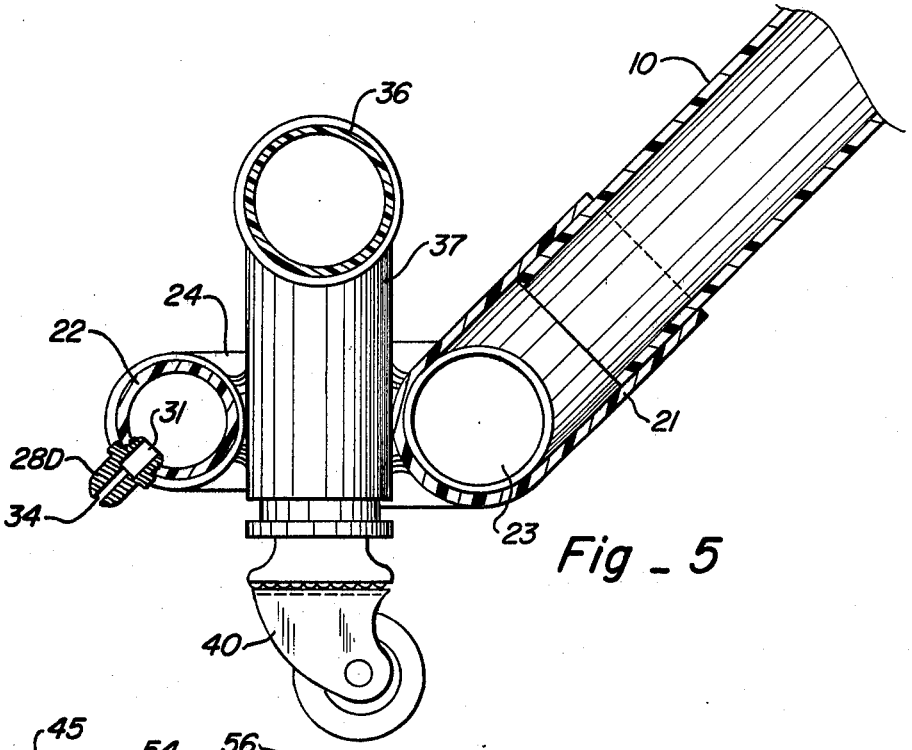
FIG. 5 is a side section and partially broken view of the crossbeam assembly taken along line 5—5 of FIG. 4.
Figure 6:
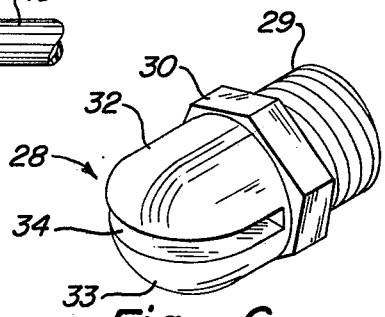
FIG. 6 is a perspective view of a typical nozzle useful in the preferred embodiment.

As can be seen in FIGS. 1, 3 and 4, a plurality of nozzles 28 are attached to front pipe member 22 with seven such nozzles 28A–28G being shown. These nozzles as attached and as is readily apparent in FIG. 2 are oriented so as to direct the discharge stream therefrom in a narrow, fan-like pattern against the surface to be swept with this angle being approximately the same as the angle of orientation of handle 10 relative to that surface when the device is in normal usage. A typical nozzle 28 is illustrated in perspective view in FIG. 6 and includes a threaded rear portion 29 and a shoulder 30 formed as a nut to permit threadedly attaching nozzle 28 to member 22 as shown in the section view of FIG. 5. Nozzle 28 includes a hollow central passageway 31 visible in FIG. 5 which opens at one end interiorly of member 22 and terminates in a narrow slot 34 defined by the facing interior surfaces of outwardly extending shoulders 32 and 33. Thus water discharged from bore 31 into slot 34 is formed by shoulders 32 and 33 into the narrow, fan-like spray as generally depicted in FIG. 1. The number of such nozzles 28 and their positioning along the front member 22 depends upon the amount of overlap of the flow patterns desired as well as the size of the elements involved and their spacing above the surface when the assembly is completed.

Reinforcing of the crossbeam assembly is further enhanced by U-shaped member 35 which is formed with an elongated central element 36 and downwardly directed side arms 37 and 38. Downwardly depending side arms 37 and 38 are bonded around the perimeter thereof to the corner junctions between members 22–25 of the rectangular pipe assembly 20. At the lower ends of arms 37 and 38 a pair of wheels or casters 40 and 41 are attached in conventional manner for horizontal and vertical rotation thereof to provide surface support of the total crossbeam assembly 12. As is clearly evident in FIGS. 2 and 5, the offset mounting relationship of the wheels 40 and 41 relative to the spray nozzle 28 array across front member 22 establishes an increased range of angle of impingement control for the discharge spray from nozzle 28 relative to handle 10. That is, in contrast to the prior art devices, the user can lift handle 10 and pivot spray assembly nozzles 28 around wheels 40 and 41 so that the spray pattern is directed at a steep angle or even perpendicular to the surface as is required on occasion for particularly obstinate debris, grease and the like, but still maintain acceptable separation between the discharge ports or slots 34 of nozzles 28 and the surface. In addition, a shallower angle of impingement can be obtained by lowering handles 10 and effecting a more efficient pushing operation from the nozzle discharges.

Figure 7:
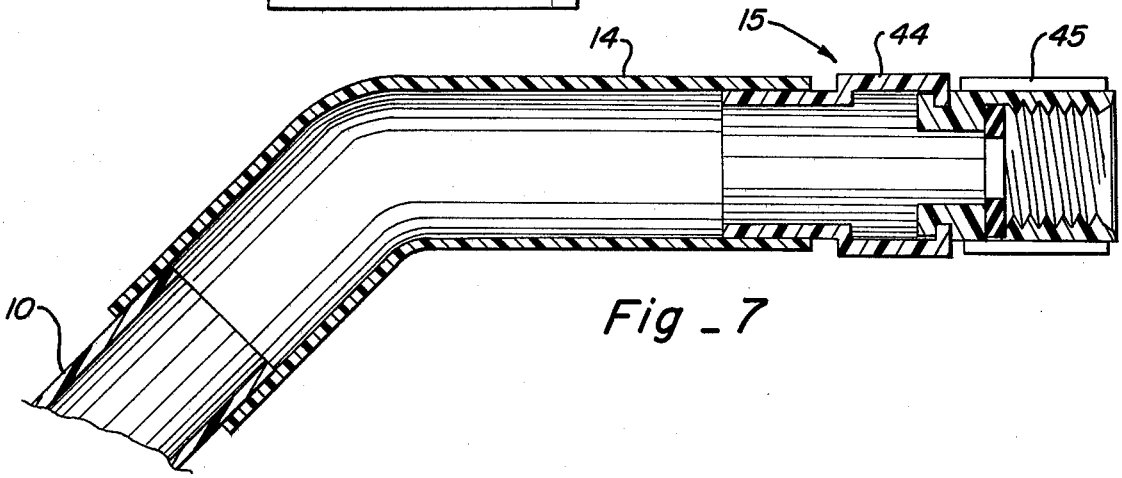
FIG. 7 shows a side section view of the attachment assembly taken along line 7—7 of FIG. 1 at the end of the handle.

The assembly 15 for attachment of handle 10 to a hose (shown in phantom at 18 in FIG. 1) is illustrated in greater detail in FIG. 7. Elbow sleeve 14 is bonded at one end to tubular handle 10 so as to form an angled grip. Elbow 14 can be fabricated from or supplemented by heat insulating material if desired for greater comfort in usage. A sleeve 44 is bonded to the opposite end of sleeve 14 and has a threaded assembly 45 rotatably retained therein for attachment to a hose.

Figure 8:
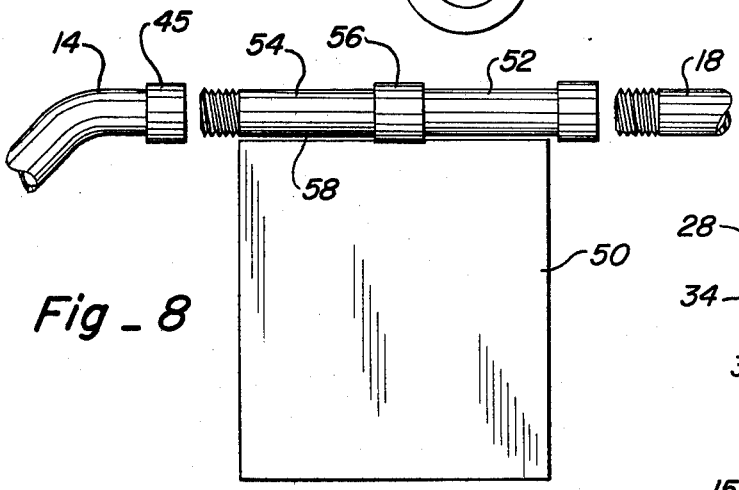
FIG. 8 is an exploded assembly view illustrating a typical attachment for a feed supplement container in association with the preferred embodiment.

The introduction of supplementary materials, such as liquid soap, detergents, fertilizers or the like can be easily accomplished in accordance with the present invention by an attachment such as is illustrated in FIG. 8. Container 50 for the liquid to be injected into the fluidic flow line has an inlet pipe 52 for conventional coupling to hose 18 and an outlet pipe 54 connected to 45 for producing an in-line attachment. The container 50 is discharged into the flow stream between hose 18 and handle 14 via conventional venturi or aspirator-type of injection. The venturi or aspirator type mixer section 56 is not shown in detail nor is the on/off control of such mixing since they are conventional. Thus, a vent port (not shown) can be incorporated in upper surface 58 of container 50 and can be selectably open to allow air entry into container 50 thus supporting injection flow or closed to prevent such injection flow and allow normal operation of the broom without supplementation. Any type of valving mechanism can be included for this injection control as is well known in the art. In addition, a separate in-line on/off valve with or without container 50 can likewise be attached if desired or included as an integral element with handle 10.

In typical usage, attachment assembly 15 is coupled to a water pressurized hose 18 either directly or through a supplementary liquid injector and/or an on/off valve. The total assembly is moved via surface support wheels 40 and 41 over the surface to be cleaned or swept and the angle of incidence of the effective curtain of overlapping sprays from nozzles 28 controlled by the vertical positioning of handle 10 by the user. The forward and downward direction of the nozzles in normal orientation effects loosening and pushing of debris in the direction of travel with the previously loosened debris and water being effectively swep ahead. As particularly stubborn debris elements are encountered, the handle is lifted upwardly in a vertical direction thereby pivoting the nozzle array around support wheels 40 and 41 so as to effect a more vertical impingement of the spray upon the area to be loosened and removed.

It has been found in practice that an angle of orientation relative to the surface of roughly 30° to 45° for both handle 10 and the angle of impingement of the nozzle 28 discharge when rectangular pipe assembly 20 is generally horizontal is satisfactory for most applications. In a typical implementation of the invention, tubular handle 10 is of 0.75 inch PVC with 48 inch length. Rear member 23 of rectangular assembly 20 is likewise of 0.75 inch PVC with a total separation between ends of 21 inches. Each of the side portions 24 and 25 of rectangular pipe assembly 20 are preferably formed with a pair of matching 0.75 inch 90° joints or streets with the nozzle containing front member 22 being 0.50 inch PVC of 21 inch length. Nozzles 28 are preferably fabricated from brass for longer life with shoulders 32 and 33 being approximately 0.25 inches in diameter at the base and extending outwardly 3/16 inches from nut shoulders 30 which are ⅜ inches between flats and with slot 34 being about 1/32 inches wide. U-member 35 is formed with section 36 of 0.75 inch PVC with 19.5 inch length and the downwardly depending side arms 37 and 38 being fabricated from 90° 0.75 inch joints and 0.50 inch reducers. Elbow 15 is preferably formed with a 45° joint and the interconnecting couplings of assembly 16 are conventional hose adapter elements.

Although the present invention has been described in detail relative to the description of the exemplary preferred embodiment, various changes, modifications, additions and applications other than those specifically mentioned herein will be readily apparent to those having normal skill in the art without departing from the spirit of this invention.

What is claimed is:

1. In a device attachable to a source of pressurized flowable materials such as water or air for sweeping a surface, the improvement comprising:

a hollow, open ended, elongated, tubulr means adapted at a first end for releasable attachment to the pressurized source, first and second elongated members rigidly attached in parallel relation to one another with the second end of said tubular means being rigidly attached in perpendcular relation to at least one of said members, said first elongated member including first and second elongated portions interconnected at respective ends by a pair of side portions in a rectangular configuration and having a hollow interior in open communication with the hollow interior of said tubular means coextensive throughout said first and second elongated portions, said tubular means being rigidly attached at a second end to said second elongated portion for open communication between the hollow interiors thereof, a plurality of spray nozzles attached in an array along said first elongated portion for discharging flowable materials from the interior of said first member and in generally parallel but common directions, and movable support means movably supporting said first and second elongated members above the surface to be swept, said nozzles being positioned for impinging the discharge thereof at an angle relative to the surface when said tubular means is hand supported, and said movable support means defined by ground-engaging wheels attached for downward extension from opposite ends of said second elongated member in rearward offset relation to said first elongated portion.

2. An improved device in accordance with claim 1 wherein said nozzles each include a central passageway opening at one end into the interior of said first member and opening at the other end into a narrow slot parallel to the length of said first elongated member.

3. An improved device in accordance with claim 1 wherein said second elongated member is rigidly attached between said first elongated member side portions, said movable support means including said wheels attached to said second elongated member in proximity to said side portions.

4. An improved device in accordance with claim 3 wherein said second elongated member has a central portion and a pair of terminal portions depending from said central portion in a generally U-shaped configuration, said terminal portions being rigidly attached to respective said first member side portions and having respective said wheels attached to the ends thereof in perpendicular relation to one side of said first member rectangular configuration, said tubular means extending from the other side of said rectangular configuration at an angle approximately in conformity to the angle said nozzles discharge toward the surface to be swept.

5. An improved device in accordance with claim 1 which includes injection means having a storage container for flowable materials, inlet means adapted for attachment to the container, outlet means adapted for attachment to said first elongated member, and means intermediate said inlet and outlet means for selectably injecting materials from said container into the flow between said inlet and outlet means.

* * * * *